United States Patent [19]

Casperson

[11] 4,393,603

[45] Jul. 19, 1983

[54] DRYER THERMAL EFFICIENCY

[75] Inventor: John R. Casperson, Bartlesville, Okla.

[73] Assignee: Phillips Petroleum Company, Bartlesville, Okla.

[21] Appl. No.: 278,159

[22] Filed: Jun. 29, 1981

[51] Int. Cl.[3] ..... F26B 3/24

[52] U.S. Cl. ..... 34/39; 34/134; 34/141; 432/107; 432/112

[58] Field of Search ..... 34/134, 135, 136, 137, 34/140, 141, 142, 39; 432/105, 108, 107, 112; 165/DIG. 2, 179

[56] References Cited

U.S. PATENT DOCUMENTS

| | | | |
|---|---|---|---|
| 514,553 | 2/1894 | Jones et al. | 432/112 |
| 1,370,513 | 3/1921 | Boswell | 34/136 |
| 2,874,943 | 2/1959 | Fennell | 165/DIG. 2 |
| 3,168,383 | 2/1965 | Loewen | 34/137 |
| 3,333,344 | 8/1967 | Loewen | 34/31 |
| 3,384,974 | 5/1968 | Alleman et al. | 34/31 |
| 4,014,106 | 3/1977 | Bearce | 34/142 |
| 4,205,458 | 6/1980 | Austin | 34/134 |

*Primary Examiner*—Larry I. Schwartz

[57] ABSTRACT

The thermal efficiency of a dryer is improved by affixing to the shell of the dryer that contains the material to be dried projections which contact a heating medium surrounding the shell of the dryer and protrude into the interior of the shell. Heat is transferred from the heating medium by the projections to the material to be dried that is inside the shell of the dryer.

15 Claims, 3 Drawing Figures

DRYER THERMAL EFFICIENCY

This invention relates to dryers. In one aspect, this invention relates to improving the thermal efficiency of rotary dryers. In another aspect, this invention relates to increased heat transfer from a heat transfer medium surrounding a rotary dryer shell to the material inside the dryer shell that is being dried.

BACKGROUND OF THE INVENTION

Dryers are typically used to remove moisture from fine, dusty particulate matter such as carbon black or cement particles. For example U.S. Pat No. 3,333,344 discusses the use of rotary dryers in the manufacture of carbon black. Rotary dryers usually have a revolving cylindrical shell which is a vessel that is enclosed by a furnace housing. The material to be dried is inside the shell. A heating medium such as hot gases surrounds the shell and is contained in the furnace housing. Heat is transferred from the heating medium to the shell by radiation and convection. Heat is then transferred from the heated shell to the material to be dried that is inside the shell by conduction and radiation. The thermal energy which is transferred to the material to be dried that is inside the shell evaporates the liquid from the material. The only gases that are flowed inside the shell are those used to purge vapors of the evaporated liquid. Lifting vanes, often simply called lifters, are attached to the inner periphery of the shell to lift and shower the material to be dried. The showering increases the amount of the surface area of the material to be dried that is exposed to heat and to purge gases.

The material to be dried in standard rotary dryers is thus only indirectly heated. The heating medium is physically separated from the material to be dried by the wall of the shell of the dryer. The heating medium heats the shell, and then the heated shell heats the material to be dried. This indirect mode of heat transfer results in a low dryer thermal efficiency. The dryer thermal efficiency is the fraction of the total energy supplied that heats and evaporates liquid from the material to be dried. Various techniques have been used to improve the thermal efficiency of rotary dryers. For instance, the lifters have been modified to increase contact between the material to be dried and the wall of the shell of the dryers. See U.S. Pat. No. 3,333,334. Also, one end of the shells of rotary dryers has been enlarged to increase material hold-up and to increase the amount of time that a given particle of material to be dried is in contact with the hot shells of the dryers. Also, indirectly heated tubes have been installed in dryer shells. These tubes extend through the dryer shell and provide for additional indirect heat transfer from the heating medium into the material to be dried. The heating medium heats the tubes that pass through the dryer shell, and the heated tubes then pass the thermal energy on to the material to be dried. Although the above and other improvements have been made in the art to improve the thermal efficiency of rotary dryers, there is still significant room for improvement.

INVENTION

It is thus one object of this invention to increase the thermal efficiency of rotary dryers.

Another object of this invention is to provide novel rotary dryers which consume less energy than conventional rotary dryers.

These and other objects, advantages, details, features, and embodiments of this invention will become apparent to those skilled in the art from the following detailed description of the invention, the appended claims, and the drawings in which:

Figure 1:
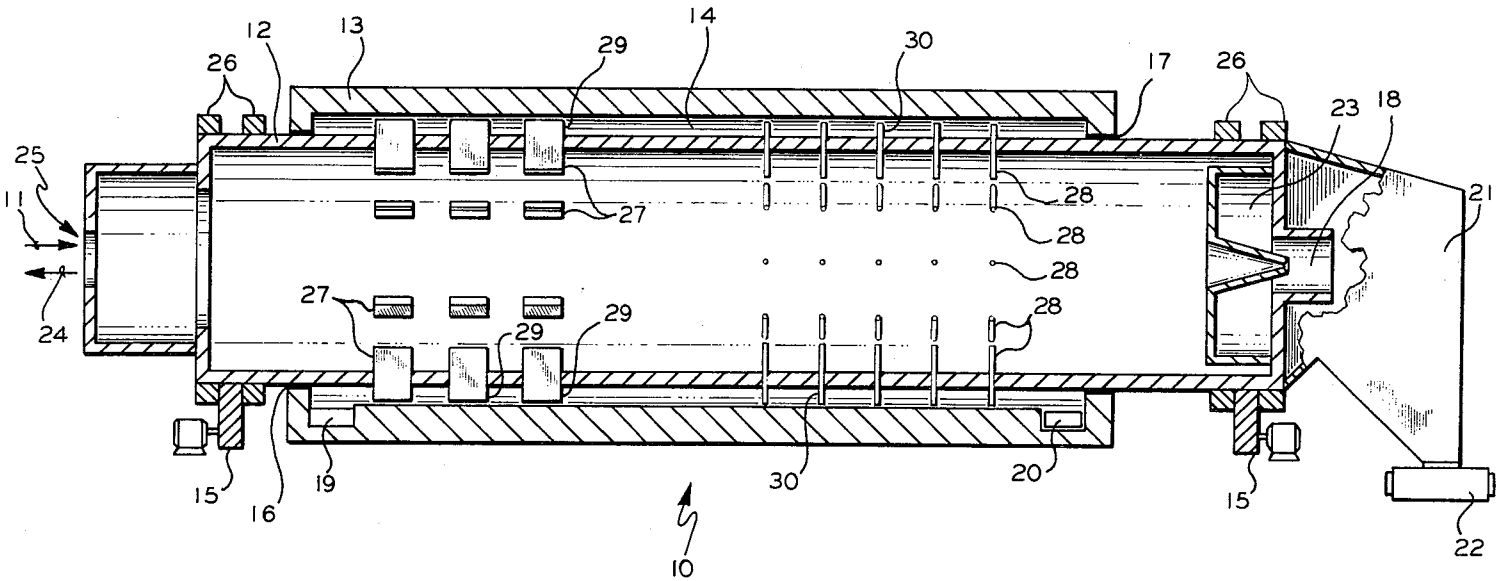
FIG. 1 shows a cross-sectional view of a rotary dryer using the improved heat transfer devices of this invention.

In accordance with this invention, the addition of projections to the shell of a dryer increases the dryer thermal efficiency. These projections extend from the interior of the dryer shell through the wall of the shell to the exterior of the dryer shell. The projections are preferably rods or fins. Also, the thermal efficiency of a rotary dryer can be increased by connecting projections, which extend from the exterior surface of the dryer shell through the wall of the dryer shell, to the lifters inside the shell of the dryer. A heating medium which contacts and/or surrounds the dryer shell can contact the projections. The projections are heated by the heating medium, and this heat is then indirectly transferred to material to be dried inside the dryer shell.

This invention applies to the removal of a liquid or liquids from various types or mixtures of particulate matter. For example, this invention applies to the removal of liquid from particulate matter such as particles and/or pellets of carbon black, cement, sand, oil shale, and materials, similar or dissimilar, which can tend to form fine particles. The liquid to be removed can be water, a paraffin, a naphthene, or an aromatic compound. The liquid can be a pelleting agent, for compounds like carbon black, such as water, aqueous molasses solution, oils, polyethoxylated amines, or other known pelleting agents.

In accordance with a first embodiment of this invention, particulate matter containing liquid can have the liquid removed therefrom by a dryer having heat transfer projections. The particulate matter containing liquid can be manipulated so as to approach dryness. That is, substantially all liquid can be removed and the particulate matter can become substantially liquid free. Also, the material within the dryer can be so treated to obtain a material having a desired or specific concentration of liquid. The particulate matter containing a liquid can be fed into a vessel. The vessel can be in contact with a heating medium. The heating medium can be a heat transfer gas or fluid. The heating medium can be hot gases such as warm air or hot combustion gases derived from the combustion of a fuel in the presence of a free oxygen containing gas such as air. The heating medium can also be a liquid heat transfer medium that has received thermal energy in a heat exchange process. The heating medium preferably nearly or completely surrounds the vessel and conveys heat to the vessel. The vessel can have projections which extend from the interior of the vessel through the walls and/or ends of the vessel to the exterior of the vessel. The projections can contact, interrelate with, or communicate with the heating medium. They can be rods or fins. Preferably the projections are rods or fins which are integral to lifters affixed to the inner periphery of the vessel. Since the projections are exposed to the heating medium and are heated, they can pass thermal energy from the heating medium to the material to be dried within the dryer. The particulate matter containing liquid which is inside the shell of the dryer is thus preferably exposed to the projections. The liquid can be driven off or removed from the particulate matter by vaporization of the liquid with the heated projections being a source of a portion of the thermal energy used for the vaporization.

In one variation of this embodiment, liquid removed from the particulate matter can be withdrawn from the vessel by passing a purge gas through the vessel. The purge gas can be warm air, a combustion gas, or can be a a portion of a gaseous heating medium which contacts the vessel.

The following specific embodiments are directed to the use of rotary dryers in the drying of carbon black pellets. Those skilled in the art understand that this invention is applicable to dryers regardless of the material to be dried.

In accordance with a second embodiment of this invention, pellets preferably of a particulate matter such as carbon black are fed into one end of the shell of a dryer. The dryer preferably is a rotary dryer. The dryer shell can be cylindrical and can revolve along its cylindrical or longitudinal axis. The shell can be contacted by or surrounded by and heated by a heating medium which can be contained within a furnace housing that can be made of suitable refractory material. As the dryer shell revolves, the carbon black pellets inside the shell can be tumbled. This tumbling increases the amount of pellet surface area that is exposed to thermal energy of the hot surface of the shell of the dryer. Liquid contained within the pellets is vaporized. A purge gas can be flowed through the inside of the dryer shell to remove the liquid which has been vaporized from the carbon black pellets. According to one variation of this embodiment, numerous rods extend from the interior of the shell of the dryer through the wall of the shell to the exterior of the shell perpendicular to the axis of the cylindrical shell. The shell of the dryer can have holes into which the rods pass. The rods can then be affixed to the shell by welding, bolting, etc. On the exterior of the dryer shell, these rods contact a heating medium such as hot gases which surrounds the dryer shell. These rods are heated, and they conduct thermal energy from the heating medium that is on the exterior of the dryer shell to the material to be dried that is on the interior of the dryer shell. Since the rods project into the interior of the shell, they transfer thermal energy by conduction to the carbon black pellets that they contact. They also transfer energy by radiation into the dryer shell. The rods also transfer heat by convection via the purge gas atmosphere (when present) to the particles. In another variation of this embodiment, fins are used instead of rods. Like the rods, the fins project into the interior of the dryer shell as an integral part from the exterior of the dryer shell. The fins not only act as heat collectors but they also act as baffles which direct the flow of heating medium around the dryer shell within the furnace housing.

In accordance with a third embodiment of this invention, the rods or fins on the exterior of the dryer shell are connected to or are made integral to the lifting vanes in the interior of the dryer shell. By affixing the rods or fins, which extend past the wall of the shell of the dryer, to the lifters which are inside the dryer shell and in contact with the material to be dried, the thermal energy of the heating medium is transferred from the portions of the rods or fins which are on the outside of the dryer shell and in contact with the heating medium to the carbon black pellets to be dried which are held on the lifting vanes inside the shell of the dryer. The term "integral" as used herein means that the vessel internal section of the projection (e.g. the rod, fin, lifter) and the vessel external section of the projection are either one integral piece (e.g. made from a single piece of heat conductive metal) or are connected solidly to maximize heat conductance via the projection through the vessel wall.

A following description contains further preferred embodiments of this invention but should not be read in an unduly limiting manner.

In the accompanying drawing, FIG. 1 is a schematic representation of the rotary dryer utilizing improved heat transfer heat scheme of the present invention which is particularly applicable to carbon black pellet drying. The wet carbon black feed 11 enters the rotary dryer system 10 via an opening 25 in the dryer shell 12. The dryer furnace housing 13 which is made of suitable metal or refractory material surrounds the cylindrical shell 12 to form a chamber 14. Shell 12 is rotated within the furnace housing 13 by a drive means 15. The shell 12 is supported and aligned by guides 26. The shell 12 or the entire system 10 may be inclined to aid in product flow through the dryer. Hot gases which heat the dryer shell 12 are fed into the chamber 14 via conduit 19 and are removed via conduit 20. Seals 16 and 17 plug the spaces between the dryer shell 12 and the furnace housing 13 to prevent the escape of hot gases. A small stream of hot gases 19 is directed by a conduit (not shown) to the stationary hood 21. This stream shown as 24 exits via opening 25 after purging vaporized liquid from the interior of the shell 12. Dried carbon black product is picked up by lifting cups 23 which guide the dried product out of the dryer shell via exit 18 into the stationary hood 23. Dried product having a reduced liquid content and which can be substantially liquid free is removed via a suitable gate or valve 22 such as a star valve. An array of lifting flights or lifting vanes 27 are attached to the shell 12 to shower material for contacting with the purge gas. These lifters 27 have integral fins or vanes 29 on the exterior of the shell 12 extending into the chamber 14. The hot gases 19 in the chamber 14 contact the shell 12 and the fins or vanes 29 of the lifters 27. Thermal energy from the gases 19 is transferred by conduction from the fins or vanes 29 to the product on the lifters 27. The thermal energy of the gases 19 in the chamber 14 is also transferred to the carbon black inside the dryer shell 12 by radiation from the lifters 27 which are heated by the contact between the fins or vanes 29 and the hot gases 19 in the chamber 14. The terms "fins" and "vanes" are here used interchangeably. They represent elongated structures which are not circular in cross section and which project from the dryer shell. The terms "pins" and "rods" are used interchangeably also. Pins and rods represent structures projecting from the dryer shell which are circular in cross section. In FIG. 1 pins or rods 28 are also used in conjunction with vanes or fins on the lifters 27, or separately. The pins or rods 28 extend through the shell. Hot gases 19 in the dryer chamber 14 contact the portion of the pins or rods 30 which is on the exterior of the dryer shell. The thermal energy of the hot gases 19 is transferred to the carbon black product inside the shell 12 by the conduction to product which is in contact with the pins or rods 28. Also, radiation of heat from the heated pins and rods 28 to the interior of the shell 12 and to the product occurs.

Figure 2:
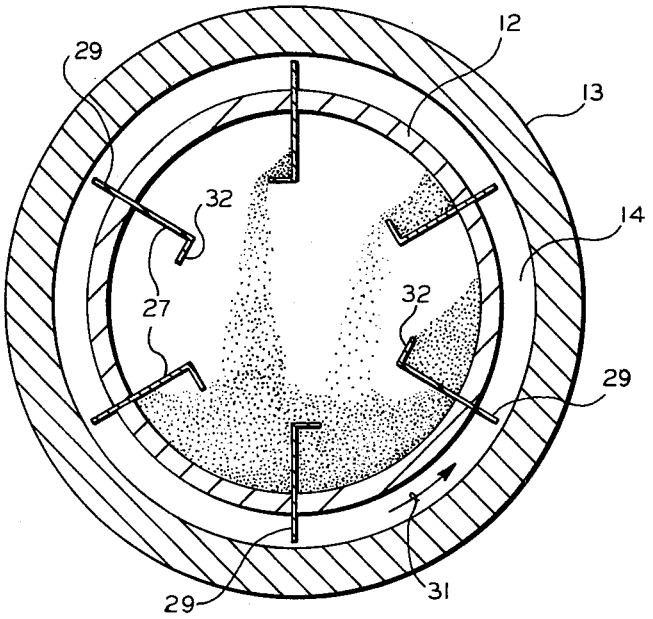
FIG. 2 shows an end view of a rotary dryer utilizing product lifters having the improved heat transfer design of this invention.

FIG. 2 shows an end view of a rotary dryer utilizing heat transfer fins or vanes of this invention. The dryer shell 12 and furnace housing 13 forms a chamber 14 wherein hot gases are passed. As the shell 12 rotates in the direction of the arrow 31, the cups 32 of the product lifters 27 hold product (indicated by the shaded area) until it falls by gravity to the bottom of the shell 12. The lifters 27 shown have vanes or fins 29 which contact the hot gases flowing through the chamber 14. Heat from the gases in the chamber 14 is thus transferred to the product on the lifters 27 by conduction. Heat is also transferred to product inside the shell 12 by radiation from heated lifters 27.

Figure 3:
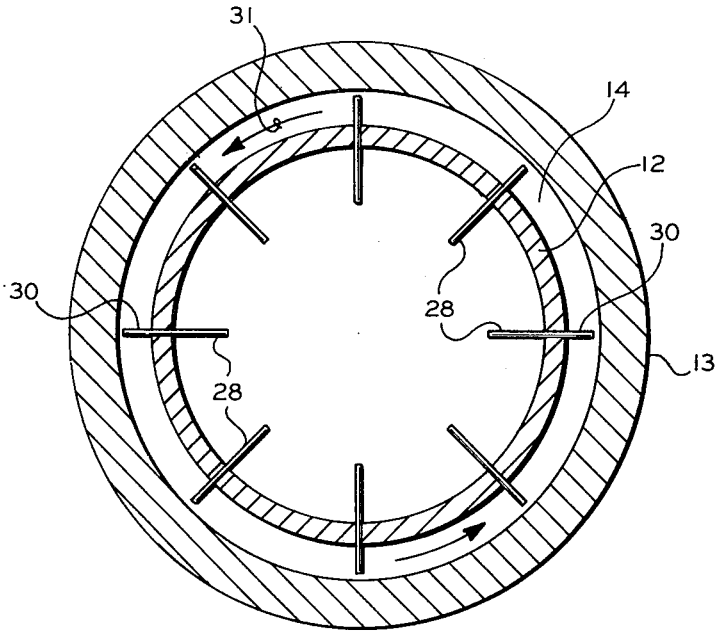
FIG. 3 shows an end view of a rotary dryer utilizing the heat transfer rods of this invention.

FIG. 3 shows an end view of a rotary dryer utilizing the heat transfer rods or pins of this invention. Again the dryer shell 12 and furnace housing 13 form a chamber 14 wherein hot gases are passed. The hot gases flowing through the chamber 14 contact the portions 30 of the pins or rods 28 which extend from the interior of the shell 12 into the chamber 14. The portion 30 of the rods or pins 28 which extend into the chamber 14 pick up heat from the gases in chamber 14. Heat is transferred by conduction from the pins or rods 28 to carbon pellets inside the shell which contact the pins or rods 28. Heat is also transferred by radiation to product inside the shell 12 from the heated pins or rods 28.

Those skilled in the art will see many modifications which can be made in the above invention. For example the number, total length, diameter, location, length of projections from the dryer shell surface, etc. of the rods or pins 28 can be varied for different dryer configurations. The material to be dried, the dryer load, dryer size, hot gas flow rates, etc. will affect the selection of the rod or pin parameters. Also, the ratio of the length of pin or rod 30 that is exposed to hot gases in the chamber 14 to the length of the rod or pin 28 that is inside the shell 12 can be varied with dryer design and operating conditions to achieve an optimum heat transfer. Furthermore, the length, width, height etc. of the vanes or fins 29 of the lifters 27 can be varied to achieve optimum heat transfer when the dryer design, number of lifters, the capacity hold product, etc. or change. Also, rods or pins can be connected to or be integral to the lifters 27 in lieu of vanes or fins. Various combinations of rods or pins, vanes or fins, lifters having vanes or fins, lifters having rods or pins, etc. can be selected to achieve an overall optimum thermal efficiency of the dryer. Those skilled in the art also understand that this invention is applicable when a heat transfer liquid is used in a chamber 14 in lieu of a gas.

Although the invention has been described in conjunction with presently preferred embodiments, is obviously not limited thereto. Reasonable variations and modifications which will become apparent to those skilled in the art can be made in this invention without departing from the spirit and scope thereof.

That which is claimed is:

1. A process for removing liquid from particulate matter which comprises:

(a) feeding said particulate matter containing the liquid into a rotary drum vessel which has attached thereto projections extending from the outside of the drum vessel through the drum vessel wall to the inside thereof, and having portions extending into the drum vessel and portions extending into the space outside of the drum vessel, (b) contacting the outside of said vessel and those portions of said projections which extend into the space surrounding said vessel with a heating medium, (c) rotating said rotary drum vessel containing said particulate material (d) exposing the particulate matter containing liquid to those inside portions of said projections which extend from the interior of the vessel through the walls of the vessel to the exterior of the vessel and which contact the heating medium that contacts the vessel thereby transferring heat through said projections, (e) vaporizing the liquid to be removed, and (f) recovering particulate matter having reduced liquid content.

2. A process in accordance with claim 1 wherein said projections are rods.

3. A process in accordance with claim 1 wherein said projections are fins.

4. A process in accordance with claim 1 wherein said projections are rods integral to lifters affixed to the inner periphery of the vessel.

5. A process in accordance with claim 1 wherein said projections are fins integral to lifters affixed to the inner periphery of the vessel.

6. A process in accordance with claim 1 wherein the liquid to be removed that has been vaporized is withdrawn from the vessel by passing a purge gas through the vessel.

7. A process in accordance with claim 1 wherein said particulate matter is carbon black and the liquid is water.

8. A process in accordance with claim 1 wherein said particulate matter is cement and the liquid is water.

9. A process in accordance with claim 1 wherein said vessel is a dryer shell rotating along its cylindrical axis.

10. A process in accordance with claim 1 wherein the heating medium is hot gases contacting the outside of said vessel and the projections.

11. An apparatus for removing liquid from particulate matter comprising:

(a) a rotary drum vessel having projections extending from the interior of said vessel through the wall of said vessel to the exterior of said vessel, the internal and the external sections of the projections forming an integral part for heat conduction, (b) a housing surrounding at least a portion of said vessel and having an interior spaced from the exterior surface of the vessel forming a chamber with said external sections of the projections extending into the space formed between said vessel and said housing, (c) means for supplying a heating medium to contact the exterior of said vessel in said chamber (d) a means for feeding particulate matter containing liquid into the vessel, (e) a first outlet means for removing particulate matter with reduced liquid content from the vessel, and (f) a second outlet means for withdrawing liquid which has been vaporized and removed from the particulate matter inside the vessel.

12. An apparatus in accordance with claim 11 wherein said vessel projections are rods.

13. An apparatus in accordance with claim 11 wherein said vessel projections are fins.

14. An apparatus in accordance with claim 11 wherein said vessel projections are rods integral to lifters affixed to the inner periphery of said vessel.

15. A process in accordance with claim 11 wherein said vessel projections are fins integral to lifters affixed to the inner periphery of said vessel.

* * * * *